US007277834B2

(12) United States Patent
Bar Tal et al.

(10) Patent No.: US 7,277,834 B2
(45) Date of Patent: Oct. 2, 2007

(54) ESTIMATING POSITION AND ORIENTATION IN ELECTROMAGNETIC SYSTEMS

(75) Inventors: Meir Bar Tal, Zichron Yakov (IL); Eytan Paldi, Haifa (IL); Mark Gandelsman, Haifa (IL); Eugene Gurovich, Yoknean (IL)

(73) Assignee: Elbit Systems Ltd., Haifa (IL)

( * ) Notice: Subject to any disclaimer, the term of this patent is extended or adjusted under 35 U.S.C. 154(b) by 858 days.

(21) Appl. No.: 10/350,792

(22) Filed: Jan. 24, 2003
(Under 37 CFR 1.47)

(65) Prior Publication Data

US 2004/0034515 A1 Feb. 19, 2004

Related U.S. Application Data

(63) Continuation of application No. PCT/IL01/00686, filed on Jul. 25, 2001.

(30) Foreign Application Priority Data

Jul. 25, 2000 (IL) ..... 137520

(51) Int. Cl.
*G06F 7/60* (2006.01)
*G06F 17/50* (2006.01)

(52) U.S. Cl. ..... 703/2; 703/13

(58) Field of Classification Search ..... 703/2, 703/13

See application file for complete search history.

(56) References Cited

U.S. PATENT DOCUMENTS 5,272,639 A 12/1993 McGuffin ..... 364/449
5,321,613 A 6/1994 Porter et al. ..... 364/420
5,457,641 A * 10/1995 Zimmer et al. ..... 702/153
5,645,077 A 7/1997 Foxlin ..... 128/774
5,847,976 A 12/1998 Lescourret
6,269,324 B1 7/2001 Rakijas et al. ..... 702/190

FOREIGN PATENT DOCUMENTS

FR 2664044 1/1992
WO WO 00/23823 4/2000

OTHER PUBLICATIONS

Supplementary European Search Report for European Patent Application No. EP01961045, Mar. 24, 2005, (3 pages).

Office Action dated Jan. 17, 2006 in the European Patent Application No. EP01961045, (4 pages).

* cited by examiner

*Primary Examiner*—Hugh Jones
(74) *Attorney, Agent, or Firm*—Steven M. Jensen; Steven M. Cohen; Edwards, Angell, Palmer & Dodge LLP

(57) ABSTRACT

A method for adapting electromagnetic (EM) field model parameters including the steps of minimizing the difference between a model for the measurements and one or more measurements. The minimizing may be done by estimating model parameters, and at least position and/or orientation. The model may further include system model parameters, wherein the system may include one or more sensors and one or more radiators.

15 Claims, 1 Drawing Sheet

ESTIMATING POSITION AND ORIENTATION IN ELECTROMAGNETIC SYSTEMS

RELATED APPLICATIONS

This application is a continuation of International Application No. PCT/IL01/00686, with an international filing date of Jul., 25, 2001, published in English under PCT Article 21(2), which claims priority to Israel Application No. 137520, filed Jul. 25, 2000.

FIELD OF THE INVENTION

The present invention generally relates to methods for magnetic modeling, and particularly to methods for determination of orientation and position therewith.

BACKGROUND OF THE INVENTION

Line of sight (LOS) systems are commonly used in targeting applications. Some typical technological implementations for LOS systems are electromagnetic (EM), optical, inertial and acoustic.

Generally, prior art EM LOS systems comprise a three-axis magnetic dipolar radiator and a three-axis magnetic dipolar sensor, which are located in a metallic surrounding, such as an airplane cockpit, a tank, or any other type of vehicle. The sensor is typically located on or near a mobile element within a restricted motion box, such as on a helmet or a crew member's seat, and the radiator is typically rigidly installed in the general area.

When the EM LOS system is activated, an EM field is generated in the area of the radiator. Utilizing known in the art electromagnetic principles and mathematical principles, it is possible to generate a model representative of the EM field, and to determine therefrom the position and orientation (P & O) of the sensor. Knowing the sensor position and orientation is very useful since this also provides information for targeting direction.

Unfortunately, the metallic parts in the surrounding react to magnetic fields, causing distortions in the electromagnetic field. Thus, since each individual vehicle has its own unique EM field, without appropriate calibrations the resultant P & O estimations may not be accurate enough for targeting purposes. In order to produce more accurate P & O estimations, common practice is to map the motion box magnetic field, estimate the EM field model, and store the mapped model coefficients in the EM LOS systems firm ware. The stored model is then used when estimating the real time P & O.

Since over the course of time mechanical installation of radiators, the electrical parameters, sensor calibrations, and so on, tend to drift, and since cockpit parts may change position slightly, the mapped magnetic model must typically be updated on a regular basis, such as annually. However, unfortunately, variations which may occur in the magnetic field between mappings are not compensated for. As such, the resultant calculations may be less accurate than desired.

One solution is to perform mapping on a more regular basis, such as weekly. Unfortunately, this is not a feasible endeavor. In order to map, the vehicle must be grounded, and mapping takes time and is expensive. Thus, there exists a need for methods and apparatus to which avoid expensive mapping of each vehicle in the fleet, that adapts to the small drifts in the EM field—regardless of the source of drift, and produces more accurate position and orientation estimations.

SUMMARY OF THE INVENTION

An object of the present invention is to provide a system for adaptive modeling.

There is therefore provided in an embodiment of the present invention a method for adapting electromagnetic (EM) field model parameters. The method includes minimizing the difference between a model for the measurements, and one or more measurements. The minimizing may be done by estimating model parameters and at least position and/or orientation. The model may further include system model parameters, wherein the system may include one or more sensors and one or more radiators.

The system model parameters may include a mathematical relationship between the EM field and actual measurables of the sensors and radiators. The step of minimizing may include determining from the system model parameters sensor and/or system parameters.

Typically estimating includes mutually estimating. Generally, the position, orientation and model parameters are observable from the one or more measurements, and are unique.

There is therefore additionally provided in an embodiment of the present invention a method for determining position and/or orientation. The method includes measuring an electromagnetic (EM) field, adapting modeled parameters of the electromagnetic field by minimizing the difference between a model for the measurements and one or more measurements. The minimizing may be done by estimating model parameters and at least position and/or orientation. Typically, the method may also include repeating the step of adapting one or more times.

Adapting may include either batch and/or recursive processing. The method may also include determining from the adapted model parameters adapted field model parameters. The method may also include using Spherical Harmonics to model the model, or any other complete harmonic functions to expand the model.

Adapting may further include determining more than one expansion centers of the model. The method may further include using a function of a radius vector from the one or more expansion centers to model the EM model. The EM field may be sensed in at least one location with one or more sensors. Multiple EM fields in each of the one or more sensors may be generated from at least one radiator.

The present invention may be used in an electromagnetic field located in one of the following environments: a helmet, a virtual reality applications, and medical probes.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
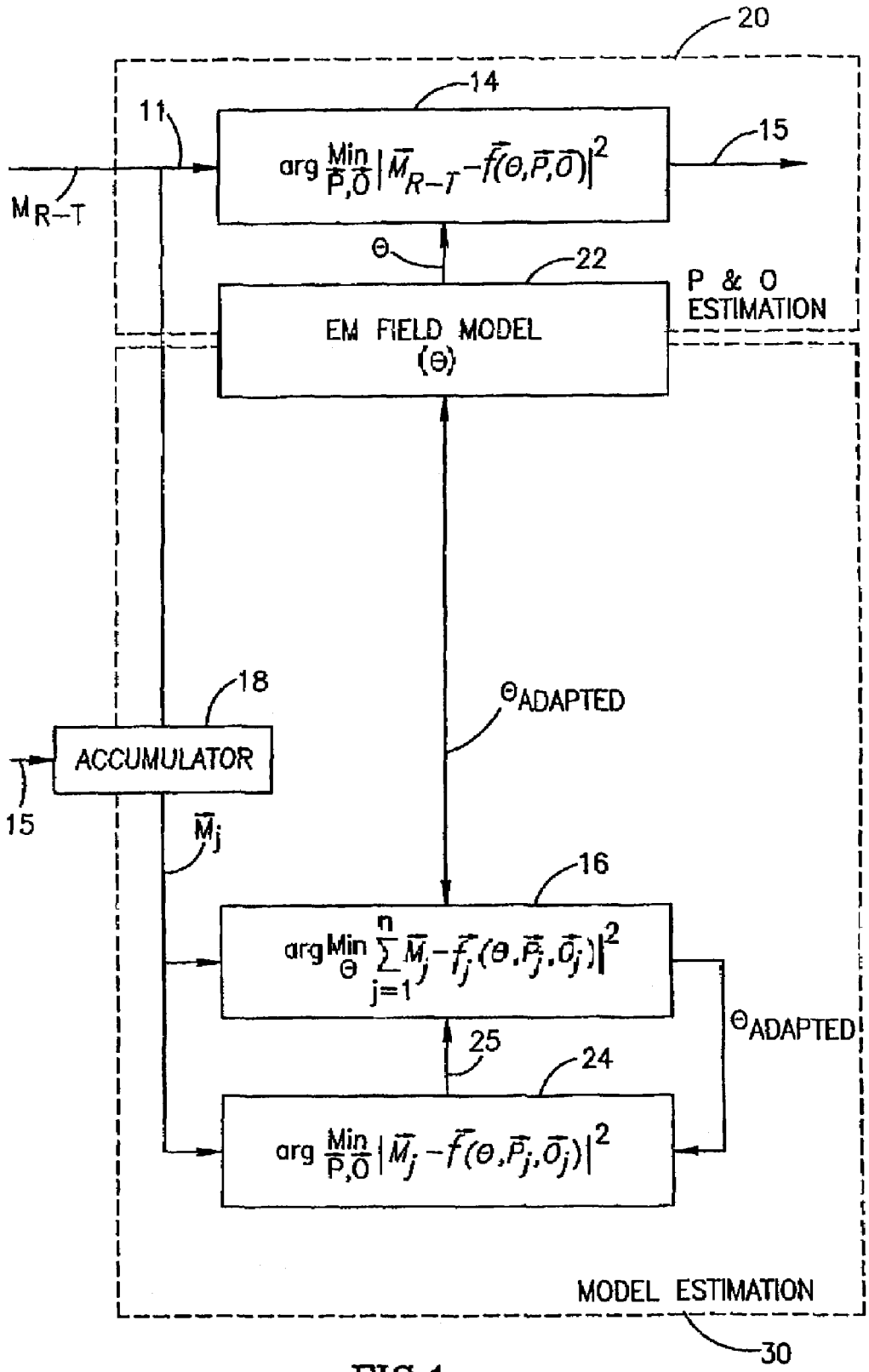
FIG. 1 is a block diagram representing a method for determining position and orientation in an electromagnetic LOS system, operative in accordance with one embodiment of the present invention.

The present invention is a method that uses adaptive modeling for determining position and orientation (P & O) in an electromagnetic line of sight (EM LOS) system.

In the following detailed description, numerous specific details are set forth in order to provide a thorough understanding of the invention. However, it will be understood by those skilled in the art that the present invention may be practiced without these specific details. In other instances, well-known methods, procedures, components, and mathematical processes have not been described in details so as not to obscure the present invention. As an example, note in an embodiment described herein the usage of spherical harmonics. Equally applicable within the principles of the present invention is the usage of other complete harmonic functions, such as elliptic harmonics, Fourier function and so on, or non-harmonic functions such as polynomial in the radius vector. Furthermore, there may be alternative operational modes for the operations set forth herein, and they shall be understood as to fall within the scope of the present invention.

The present invention does not follow traditional methods whereby the motion box EM model is a fixed factor in P & O estimation calculations. Rather, an embodiment detailed herein provides an EM model with adaptable model parameters. Thus, in some embodiments calculations may be processed on-line with generally more accurate, up-to-date model parameters, thereby endeavoring to produce generally more accurate P & O estimations.

Since prior art methods commonly teach that the EM model parameters are derived from a pre-mapped stored model, the stored model is typically left unmodified until the next mapping process. Conversely, one of the embodiments of the present invention describes a method, based on physical and mathematical concepts, which provides for generally continuous adaptation of the EM model parameters.

Moreover, one of the embodiments of the present invention teaches a method based on prototype EM model mapping, and methods derived therefrom, for determining the EM models of a specific motion box, thereby avoiding mapping of each motion box.

Reference is now made to FIG. 1, a block diagram illustrating a method for determining P & O estimations, and operative in accordance with one of the embodiments of the present invention. The embodiment described herein comprises two phases, a P & O estimation phase 20, and model estimation phase 30. Each phase will be described herein below separately.

P & O Estimation Phase 20

Phase 20 may comprise a field model 22 and a minimizer 14. Field model 22 may comprise parameters θ, where θ are the accumulation of model parameters of the magnetic field in the motion box (such as a cockpit) and the system parameters (such the sensor response to EM field). It should be understood that the scope and application of the present invention is in no way limited to these applications, and may encompass applications such as a medical applications or for virtual reality. The operations of field model 22 and minimizer 14 may be accomplished by other combinations of applications and/or by a single application.

Magnetic field real time measurements $M_{R\text{-}T}$ 11 and parameters θ, may be transferred to minimizer 14. Minimzer 14 may find P & O estimations 15 via the differences between measurements $M_{R\text{-}T}$ 11 and model $f(\theta, \vec{P}, \vec{O})$, as demonstrated by equation $$\underset{\vec{P},\vec{O}}{\text{argMin}} \sum_{i=1}^{k} \left| M_{R-T} - f_i(\theta, \vec{P}, \vec{O}) \right|^2,$$

where:

$M_{R\text{-}T}$ is $M_{R\text{-}T}$ 11 and, $f_i(\theta, \vec{P}, \vec{O})$ is a mathematical function representing the EM model and the LOS system, where:

θ are parameters θ received from field model 22, $\vec{P}$ is the position vector and $\vec{O}$ are the orientation angles, k is the number of measurements in a single sample.

It is noted that the first time model 22 is operated, and generally the only time during the life cycle of the present invention, parameters θ may be modeled in a prototype environment. After the first use, field model 22 may receive parameters θ from a model estimator 16. Thereafter, between operations, field model 22 may save parameters θ, and utilize the saved parameters θ during initialization of the next operation.

It is additionally noted, in alternative first time operations, parameters θ may be modeled in a stimulated environment, or any other first time operation that generates a first estimate of parameters θ. In such an instance, the sensors may be sampled from various locations in the motion box of the active environment, such as a cockpit.

Model Estimation Phase 30

Model estimation phase 30 may process in parallel with P & O estimation phase 20. It is noted that the operations of model 22 may be included within both phase 20 and phase 30, and thus, since the operations of model 22 are explained hereinabove, they are not discussed further hereinbelow.

Real time measurements $M_{R\text{-}T}$ 11 and P & O estimations 15 may be transferred into, and optionally stored, in an accumulator 18. P & O estimations 15 may be continuously transferred into accumulator 18. It should be understood that measurements $M_{R\text{-}T}$ 11 and other measurements referred to herein, are not limited by those measurements gathered with a single radiator and a single sensor. It is apparent to those skilled in the art that there are numerous methods to generate electromagnetic measurements, with one or more sensors and/or one or more radiators.

Accumulator 18 may compare the stored data with the real time measurements $M_{R\text{-}T}$ 11 and the P & O estimations 15. If the stored data is different from the currently received measurements $M_{R\text{-}T}$ 11, the current measurement $M_{R\text{-}T}$ 11 may be stored, otherwise the measurement $M_{R\text{-}T}$ 11 may be dumped. As an example, if the sensor changes position from the last measurement (e.g. the pilot moved his head), than accumulator 18 may store the measurement. After enough data is accumulated, accumulator 18 may transfer the data, generally designated measurements $M_j$ 21, where j is the sample index, to a second minimizer 24 and model estimator 16.

It is noted that the usage of accumulator 18 is optional, and it should be understood that the scope of the present invention is not limited to this example. In alternative embodiments, measurements $M_{R-T}$ 11 may be transferred directly to minimizer 24 and model estimator 16, or transferred via another mode of data processor.

Minimizer 24 may find P & O estimations 25 by minimizing the difference between measurements $M_j$ 21 and $f(\theta, \vec{P}_j, \vec{O}_j)$, as demonstrated by the function $$\underset{\vec{P},\vec{O}}{\text{argMin}}\left|M_j - f(\theta, \vec{P}_j, \vec{O}_j)\right|^2,$$

where:

$M_j$ 21 is measurements $M_j$ 21, n the number of accumulated measurements $P_j$ is the position vector for the $j^{th}$ measurement, and $O_j$ are the orientation angles for the $j^{th}$ measurement. It is noted that typically parameters θ are received from model estimator 16, however, as noted above, during the first time use of the present invention, parameters θ may be modeled from either an active environment or a prototype environment.

P & O estimations 25, along with measurements $M_j$ 21 may be transferred to, and accumulated in, model estimator 16, which may batch process the data. Model estimator 16 may find updated parameters θ, generally designated parameters $\theta_{adapted}$, via the differences between measurements $M_j$ 21 and $f(\theta, \vec{P}_j, \vec{O}_j)$, as demonstrated by equation $$\underset{\theta}{\text{argMin}}\sum_{j=1}^{n}\left|M_j - f(\theta, \vec{P}_j, \vec{O}_j)\right|^2$$

where:

$\vec{P}_j, \vec{O}_j$ are P & O estimations 25 as received from minimizer 24

Model estimator 16 may generally continuously transfer parameters $\theta_{adapted}$ to minimizer 24, and periodically transfer parameters $\theta_{adapted}$ to model 22. It should be understood that the function described herein above is an example, whereas the minimizing function may be implemented by other possible cost functions.

It should be understood by those skilled in the art that minimizer 24 and model estimator 16 may execute batch computation or be implemented in a sequential manner (such as using Kalman filter). Within the same principles, the operations of minimizer 24 and model estimator 16 may be reversed, and/or performed by a single process. It should be noted that the principles covered within are not to be limited to these examples, and other forms of mathematical computations which mutually minimize $\vec{P}_j, \vec{O}_j$ and θ, (given a mathematical model that relates them to the measurements), are applicable and covered within the principles of the present invention.

It is noted that the stopping criteria for model estimator 16, which determines when model estimator 16 terminates batch processing and transfers parameters $\theta_{adapted}$, may be the average figure of merit (FOM). FOM for each measurement may be generated from the below equation:

$$FOM = \sqrt{\frac{\sum_{i}^{k}\left(M_i - f_i(\theta, \vec{P}, \vec{O})\right)^2}{\sum_{i}^{k}(M_i)^2}}$$

where:

$M_i$ is the $i^{th}$ elements of the measurement (k=9 in the case of triple coil sensor and triple coil radiator), and $f_i(\theta, \vec{P}, \vec{O})$ is the $i^{th}$ element of the model estimation.

When the FOM reaches minimum, parameters $\theta_{adapted}$ may be transferred to model 22. Model 22 may then replace the parameters θ currently comprised therein with parameters $\theta_{adapted}$ (generally designating them as parameters θ). The newly replaced adapted parameters θ may then transferred to minimizer 14, which starts using the updated adapted parameters θ in its minimizing function, producing the P & O estimations 15 therefrom.

It is noted that the above described method operates on a generally continuous cycle, and hence, over the time period of the process, the P & O estimations 15 may be continuously more accurate.

The above is an example of one possible embodiment, plus alternatives, for operation of the present invention. Presented below, is a mathematical basis for the present invention.

Mathematical Basis

The function $f(\theta t, \vec{P}, \vec{O})$, as utilized in various functions noted hereinabove, may be derived from the following:

$$\vec{B}=\begin{bmatrix}x\\y\\z\end{bmatrix}=R\cdot\begin{bmatrix}h_{1,1}(\vec{r}-\vec{r}c_1)\ \ldots\ h_{1,p}(\vec{r}-\vec{r}c_1);\ h_{1,p+1}(\vec{r}-\vec{r}c_2)\ \ldots\ h_{1,n}(\vec{r}-\vec{r}c_q)\\ \cdots\\ h_{3,1}(\vec{r}-\vec{r}c_1)\ \ldots\ h_{3,p}(\vec{r}-\vec{r}c_1);\ h_{3,p+1}(\vec{r}-\vec{r}c_2)\ \ldots\ h_{3,n}(\vec{r}-\vec{r}c_q)\end{bmatrix}\begin{bmatrix}\theta t_1\\ \ldots\\ \ldots\\ \ldots\\ \ldots\\ \theta t_n\end{bmatrix}$$

or in a more compact way: $\vec{B}=R\cdot H\cdot\theta\,\vec{t}$ where, $\vec{B}$ is the EM field at the sensor location, R is the rotation matrix between sensor coordinates and a reference system coordinates, $h_{l,m}(\vec{r}-\vec{r}c_q)$ is a function in a complete harmonic function set or any other function of the location, $\vec{r}$—the sensor location, $\vec{r}c_p$—expansion centers out of q expansions centers used, and $\theta t_1 \ldots \theta t_n$ are the EM model parameters.

In cases where the sensor senses several EM fields (such in a case of multiple frequency generation, or where the field is generated sequentially, or any other way of generating multiple EM fields) the above equation can be widened by adding columns to parameters θt, which result in more columns in field $\vec{B}$.

Any factor which causes the EM field to change electronically may be added on the right side of the equation i.e., a change in the current through the radiator coils may be added as a current matrix A. In such a case, the diagonal may be a drive current, and out of diagonal may be a current induced from one coil to another. Usually the currents are measured and are part of the measurements $M_{R\text{-}T}$.

The effect of the sensor response may be modeled by placing a the sensor response matrix on the left side of the equation, which in a more general representation maybe: M=θr·R·H·θt·A In this representation:

M is the sensor/s measurement (such as voltages)—for example, a 9-measurements vector in the case of triple coil sensor with a triple coil radiator.

θr is a matrix describing each sensor's response to an EM field at its center. In the case where a sensor can not be modeled as a point (such as where the sensor is large) in the dimension of a problem, the model can be even wider to reflect this effect. One way to do so is to model the EM field not only in the sensor center, but in some other places around the center. Thus B=R·H·θt·A is a set of EM field vectors modeled around the sensor center. Multiplying by parameters θr is equivalent to polynomial expansion of the sensor response to the EM field around its center.

The above discussion clarifies that a mathematical model of a general sensor readout from a general EM field generator can be laid out mathematically. It is noted that in an embodiment described herein $f(\theta,\vec{P},\vec{O})$ is modeled with spherical harmonics in order to benefit from advantages of compactness, however, in the same vein, $f(\theta\,\vec{P},\vec{O})$ may be modeled via any complete harmonic function set that span a field solution which bear the Maxwell equations, or any other base function. As such, in an embodiment of the present invention, alternative mathematical models may be operable and understood to fall within the scope of the present invention.

It is noted that alternatives of the present invention comprise methods for determining at least one of position and orientation and/or combinations of the two. As such, alternative mathematical possibilities for determining at least one of position and orientation without determining the other are included within the scope of the present invention.

Since the problem of extracting the P & O and model coefficients θ from the measurements $M_j$ may be done over n different samples, an investigation of the solution uniqueness is required. The n samples hold n×k different measurements, where:

n is the number is samples used for the minimization, and k is the number of measurements (9 in a single triple coil sensor and radiator case—note that in a case of a plurality of sensors or radiators, k represents all the measurement made in a single sample. As an example, for two triple coil sensors, k may be 18 measurements).

The unknown variables in the minimization equation are the 6×n degrees of freedom of the P & O, for all the samples, where:

6 is the product of 3 degrees of freedom for each of the 2 vectors (P and O).

In the case the EM field is modeled by spherical harmonics the EM model coefficients $\theta_t$ that are valid for all the samples, are:

$$\sum_{i=1}^{q} SpH^i(SpH^i+2)$$

where:

q is the number of expansion center and $SpH^i$ is the harmonic order of expansion for the center i.

Other model parameters may include: the sensor reaction to EM field around it, amplification of the electronic circuitry, mechanical dimensions—such as inter sensor or inter radiator radius vector, etc. In any case these are bounded to be applicable for all the samples.

Sampling in enough locations guarantees that the number of measurements are greater than the number of variables (degrees of freedom), and that the solution is unique, such that in the case of triple coil radiator and sensor $$n \times 9 \times q > (n \times 6) + 3\sum_{i}^{q} SpH^{i}(SpH^{i}+2) + \text{number of sensor model variables}$$

It is noted that the results, $\vec{P}_j, \vec{O}_j$ and θ should be observable from the measurements. Is should be apparent to those skilled in the arts that there are various common art methods for testing observeability, however, with a single point source sensors (as generally used in prior art) and a single radiator, observeability is difficult to achieve.

As such, one method for solving observability may comprise sampling with sensor clusters, wherein the clusters not limited to only point source sensor, however, also encompass sensors that sense a volume. As an example, sensor clusters may comprise either one sensor that is larger than typical point measuring sensors, or a plurality of point source sensors joined in a rigid manner. The use of sensor clusters may offer a larger sensed area and thus, substantially guarantee observability in the motion box.

It should be additionally understood that the scope of the present invention is not limited to sampling with only one sensor and one radiator, as is commonly practiced in prior art methods. Rather, the present invention is understood to be operational with one or more sensors and/or one or more radiators. Therefore, additionally applicable may be combinations of radiators and sensors, which may produce unique solutions. An example of such may be 2 radiators with 1 sensor having a single axis, or a 3-dimensional Helmholz radiator with a 3 coil sensor, and so on.

An example of an operable set-up for the above described invention may be an instance of three orthogonal dipolar dominate radiator with two rigidly-connected triple-point-sensing sensor. It should be understood that this is a single example of the many possible operable variations.

It is also noted that embodiments of the present invention teach producing more stable results by using multiple expansion centers. This may be an advantage over prior art systems which typically teach the use of only one expansion center. Although the present invention is mathematically possible with only one expansion center, the result may be unstable. Hence, prior art systems generally teach away from the present invention, since the results are not generally stable enough to produce accurate enough results.

Multiple expansion centers as may be sampled from multiple sensors located in the cockpit motion box, such as near the seat or other large metal part which reacts to the source field. Any change in the metal part, or its position thereof, may translate to a change in the EM field near the change. This change may affect the expansion center coefficients close to volume affected, which is a physically more accurate model than changing the coefficients of a global model where the center of expansion is far from the affected volume. This thus produces more stable mathematical solutions.

It should be understood by those skilled in the art that adaptation of parameters θ also adapts $\theta_R$ and $\theta_t$, and they subsequently reflect the actual on-going drift of the sensor and electronic field, respectively. The present invention thus may provide a useful tool is measuring the drift of the sensor and electronic field, respectively.

It should be apparent to those skilled in the art that although the invention presented herein is applicable for LOS systems in an electromagnetic environment, and is not necessarily limited to use in the applications detailed herein. It will be appreciated by persons skilled in the art that the present invention is not limited by what has been particularly shown and described herein above. Rather the scope of the invention is defined by the claims that follow.

The invention claimed is:

1. A method for estimating at least one of position and orientation of a mobile element disposed within a motion box, said mobile element coupled to at least one electromagnetic (EM) field sensor, said motion box including an EM field radiator for generating an EM field in said motion box, the method comprising the procedures of:

(i) measuring at least one current EM field measurement of said EM field in said motion box, with said least one EM field sensor;

(ii) generating adapted estimates of EM field model parameters by minimizing, with respect to said EM field model parameters, the difference between at least one periodically updated EM field measurement of said at least one current EM field measurement and an EM field model function, where said EM field model function is continuously updated using adapted estimates of said respective at least one of position and orientation;

(iii) generating said adapted estimates of respective at least one of position and orientation by minimizing, with respect to said at least one of position and orientation, the difference between said at least one periodically updated EM field measurement and said EM field model function, where said EM field model function is continuously updated using said adapted estimates of EM field model parameters;

(iv) providing estimates of said at least one of position and orientation of said at least one EM field sensor, by minimizing with respect to said at least one of position and orientation, the difference between said at least one current EM field measurement and said EM field model function, where said EM field model function is periodically updated using said adapted estimates of EM field model parameters; and (v) determining at least one of position and orientation of said mobile element according to said estimates of said at least one of position and orientation of said at least one EM field sensor.

2. The method for estimating at least one of position and orientation according to claim 1, wherein said EM field model parameters comprise the accumulation of model parameters of the EM field in the motion box and parameters respective of the response of said at least one EM field sensors to EM field in said motion box.

3. The method for estimating at least one of position and orientation according to claim 1, wherein a mathematical relationship exists between said at least one current EM field measurement and said position, orientation, and EM field model parameters.

4. The method for estimating at least one of position and orientation according to claim 1, further comprising repeating any one of said procedures one or more times.

5. The method for estimating at least one of position and orientation according to claim 1, wherein any one of said procedures further comprises at least one of: batch and recursive processing.

6. The method for estimating at least one of position and orientation according to claim 1, further comprising modeling said EM field using spherical harmonics.

7. The method for estimating at least one of position and orientation according to claim 1, further comprising expanding a model for said EM field with complete harmonic functions.

8. The method for estimating at least one of position and orientation according to claim 1, wherein said procedures (ii), (iii), and (iv), further comprise determining at least one expansion center of a model for said EM field.

9. The method for estimating at least one of position and orientation according to claim 8, further comprising modeling said model using a function of a radius vector from said at least one expansion center.

10. The method for estimating at least one of position and orientation according to claim 1, wherein said motion box is selected from the list consisting of: airplane cockpit, tank, vehicle; and an environment in which a medical probe is tracked.

11. The method for estimating at least one of position and orientation according to claim 1, wherein said mobile element is selected from the list consisting of: helmet, vehicle seat, and medical probe.

12. The method for estimating at least one of position and orientation according to claim 11, wherein said helmet is selected from the list consisting of: aircraft pilot helmet, tank crew member helmet, vehicle rider helmet, and virtual reality player helmet.

13. The method for estimating at least one of position and orientation according to claim 1, further comprising the procedure of:

(vi) targeting direction according to said at least one of position and orientation of said mobile element.

14. The method for estimating at least one of position and orientation according to claim 1, wherein said EM field radiator is a three axis EM dipolar radiator.

15. The method for estimating at least one of position and orientation according to claim 1, wherein said at least one EM field sensor is a three axis EM dipolar sensor.

* * * * *

UNITED STATES PATENT AND TRADEMARK OFFICE

CERTIFICATE OF CORRECTION

PATENT NO. : 7,277,834 B2
APPLICATION NO. : 10/350792
DATED : October 2, 2007
INVENTOR(S) : Bar Tal et al.

It is certified that error appears in the above-identified patent and that said Letters Patent is hereby corrected as shown below:

On the cover page, the address of inventor Gurovich is changed from "Yoknean" to --Yokneam--.

Column 4, line 1, after "such" insert --as--.

Column 7, line 45, change "sensor/s" to --sensor's--.

Column 7, line 67, change "span" to --spans--.

Column 8, line 67, after "sensor" insert a period --.--.

Column 9, line 10, change "Is" to --It--.

Column 9, line 12, after "with" delete --a--.

Column 9, line 17, change "sensor" to --sensors--.

Column 9, line 39, change "sensor" to --sensors--.

Column 10, line 9, change "is" to --in--.

Column 10, line 13, change "and" to --it--.

UNITED STATES PATENT AND TRADEMARK OFFICE

CERTIFICATE OF CORRECTION

PATENT NO. : 7,277,834 B2
APPLICATION NO. : 10/350792
DATED : October 2, 2007
INVENTOR(S) : Bar Tal et al.

It is certified that error appears in the above-identified patent and that said Letters Patent is hereby corrected as shown below:

In the Claims:

In Claim 1, column 10, line 29, before "least" insert --at--.

In Claim 2, column 10, line 65, change "sensors" to --sensor--.

Signed and Sealed this

First Day of April, 2008

JON W. DUDAS
*Director of the United States Patent and Trademark Office*